US005794502A

United States Patent [19]

Arens et al.

[11] Patent Number: 5,794,502

[45] Date of Patent: Aug. 18, 1998

[54] TWO PIECE PUNCH FOR ROLL PIERCING MATERIALS

[76] Inventors: Cornelis G. Arens, 9100 Hubbell, Detroit, Mich. 48228-2394; William Anthony Meyer, 28339 Edward, Roseville, Mich. 48066

[21] Appl. No.: 171,558

[22] Filed: Dec. 20, 1993

Related U.S. Application Data

[63] Continuation-in-part of Ser. No. 454,413, Dec. 21, 1989, abandoned.

[51] Int. Cl.[6] ..... B26F 1/14

[52] U.S. Cl. ..... 83/670; 83/345; 83/698.41

[58] Field of Search ..... 83/30, 345, 660, 83/669, 670, 698.41, 698.42

[56] References Cited

U.S. PATENT DOCUMENTS

| | | | |
|---|---|---|---|
| 1,485,782 | 3/1924 | Fischer | 83/670 |
| 3,116,536 | 1/1964 | Tobey | 83/669 X |
| 3,192,810 | 7/1965 | Amato | 83/670 X |
| 3,205,744 | 9/1965 | Huck | 83/670 X |
| 4,326,909 | 4/1982 | Slavik | 83/660 X |
| 4,459,891 | 7/1984 | Kies et al. | 83/348 X |
| 4,653,363 | 3/1987 | Lang | 83/660 X |

FOREIGN PATENT DOCUMENTS

| | | | |
|---|---|---|---|
| 46-38017 | 11/1971 | Japan | 83/660 |

*Primary Examiner*—Eugenia Jones

[57] ABSTRACT

A punch roll which may be used in existing roll piercing systems. The punch roll has radially oriented punches which cooperate with dies upon coordinated rotation to pierce holes in material. The punch roll features a two-piece construction. The two pieces include an annular ring which is maintained in coaxial relationship with a cylindrical member. In the preferred embodiment, the cylindrical member has axially oriented spline-like recessed portions formed in the peripheral surfaces thereof. The recessed portions are preferably oriented parallel to the axis of the member. In the punch roll annular member, the radially oriented bores provide a close tolerance sliding fit with a first portion of a punch. The second portion of the punch has a larger cross-section than the first and is received in the recessed portion located between the annular ring and the cylindrical member. In this manner, the bores in the outer member and the recesses in the cylindrical member cooperate to retain the punches in preselected radially oriented positions. In the punch roll, the innermost portion of the punch abuts the peripheral surface of the cylindrical member and thereby transmits all of the forces from the piercing operation directly to the cylindrical member.

1 Claim, 1 Drawing Sheet

TWO PIECE PUNCH FOR ROLL PIERCING MATERIALS

This application is a continuation-in-part of patent application Ser. No. 07/454,413, filed Dec. 21, 1989 now abandoned.

BACKGROUND OF THE INVENTION

1. Field of the Invention

This invention relates to an apparatus for roll piercing holes in material being processed in a roll piercing operation. In particular, the present invention relates to punch roll design.

2. Description of the Related Art

A conventional roll piercing operation includes a punch roll which carries punches and a die roll which carries die openings. The rolls are located, supported, and driven with respect to one another such that the punches interact with the dies to pierce holes in material passed between them. The die openings may take the form of die buttons which typically are cylindrical members having a central bore. The die buttons and punches are held in blind bores formed in the respective rolls by means of an interference fit or be set screws.

A currently practiced technique to retain punches in their respective roll is to use interference fits. Interference fits are ineffective to hold punches over time as the respective bores become worn and enlarged after repeated removal and replacement of worn punches. In fact, during the piercing operation, punches are exposed to friction forces which tend to pull the punches from the roll. This aggravates the problem of worn and weakened interference fits and consequently punches are more easily pulled from the punch roll resulting in a disruption to the piercing pattern and possible damage to the rolls themselves.

Another limitation to the use of interference fits to retain punches is that the punches offer little or no structure to hold or grasp when trying to pull them from the respective rolls. Therefore, worn punches must be removed by tapping them radially outwardly with a punch.

Another technique for retaining punches is to utilize set screws. In such rolls, the punches must be installed in radially oriented bores offering a loose slip fit to enable positioning of the punch before the respective set screw is tightened. In addition, a slip fit is necessary as it permits ready removal of punches after the set screws have been loosened. A disadvantage of using set screws to retain punches is that the clearance between the radially oriented bores and the respective punches can lead to positional inaccuracies as the respective members are displaced to one side when the set screws are tightened. Another disadvantage is that the set screws loosen during use, allowing the respective punch to fall from the roll. Finally, the network of threaded bores required to accommodate the set screws results in a substantial reduction of the structural integrity of the roll.

SUMMARY OF THE PRESENT INVENTION

The preferred embodiment of the present invention includes a punch roll which may be used in existing roll piercing systems. The punch roll has radially oriented punches which cooperate with dies upon coordinated rotation to pierce holes in material. The punch roll features a two-piece construction. The two pierces include an annular ring which is maintained in coaxial relationship with a cylindrical member. In the preferred embodiment, the cylindrical member has axially oriented spline-like recessed portions formed in the peripheral surfaces thereof. The recessed portions are preferably oriented parallel to the axis of the member.

In the punch roll annular member, the radially oriented bores provide a close tolerance sliding fit with a first portion of a punch. The second portion of the punch has a larger cross-section than the first and is received in the recessed portion located between the annular ring and the cylindrical member. In this manner, the bores in the outer member and the recesses in the cylindrical member cooperate to retain the punches in preselected radially oriented positions. In the punch roll, the innermost portion of the punch abuts the peripheral surface of the cylindrical member and thereby transmits all of the forces from the piercing operation directly to the cylindrical member.

In a second preferred embodiment, the punch roll comprises an axially extending annular member defining an opening extending axially therethrough being characterized by opposed end portions each having a first radial dimension and an intermediate portion characterized by a second radial dimension. An axially extending cylindrical member defining a third radial dimension which is smaller than said first dimension such that the cylindrical member may be telescopically received within said annular member. A punch member comprising a cylindrical member is placed in close fitting relation within a radially extending bore defined in the annular member. The punch member includes an end portion having a radially enlarged dimension defining a head having an annular shoulder and an opposing second portion defining a top. The punch member is maintained in the radially extending bore by abutment of the annular shoulder against the annular member and abutment of the top against a peripheral surface of the cylindrical member. It is clear that many changes in construction and widely differing embodiments and applications of the invention will suggest themselves without departing from the scope of the invention as defined in the appended claims. The disclosures and the description herein are purely illustrative and are not intended to be in any sense limiting.

These and other aspects of the present invention will become more readily apparent by reference to the following detailed description of the embodiments as shown in the drawings.

DETAILED DESCRIPTION OF THE PREFERRED EMBODIMENT

Figure 1:
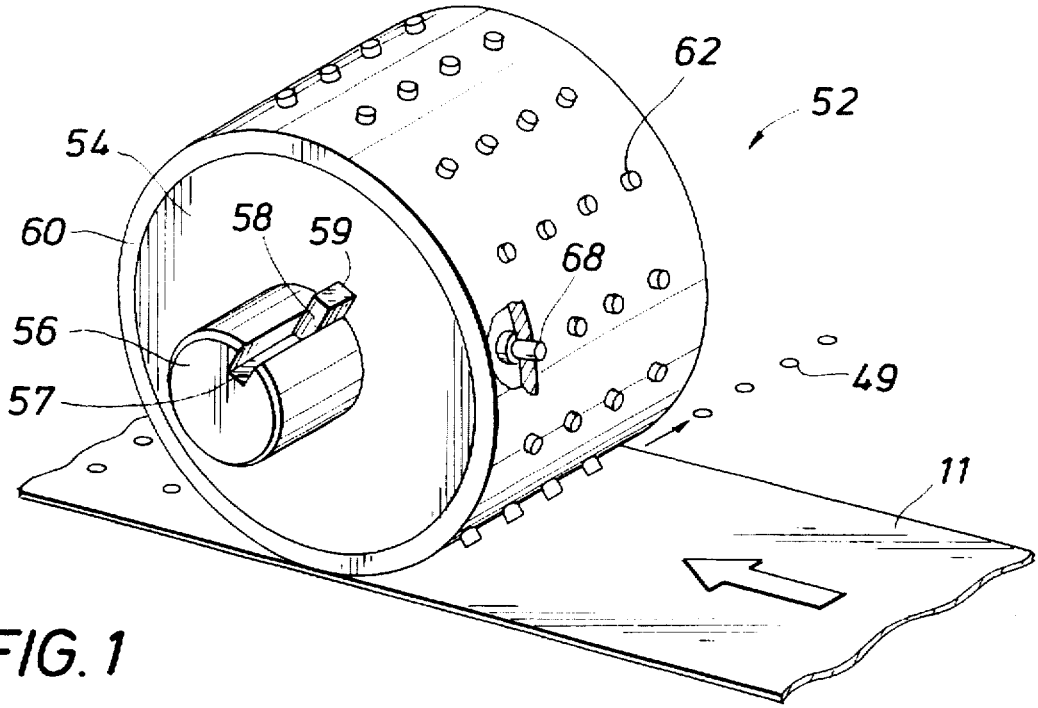
FIG. 1 is an isometric view of the preferred embodiment of the present invention.

Punch roll 52 comprising a cylindrical member 54 engaged with shaft 56 by cooperating splines 57, 59 and key 58. The annular ring member 60 is positioned with respect to the cylindrical member 54. Radially oriented bores 62 are aligned with recesses 66 formed in the periphery of the cylindrical member 54. The bores 62 receive a first portion of punches 68 and recesses 66 receive the second enlarged portion of punches 68. In this manner, the bores 62 and the recesses 66 cooperate to retain the punches by mechanical interlock in preselected positions about the punch roll.

To assemble a punch roll 52, punches 68 are installed in selected bores 62. After the punches have been installed, the annular ring member 60 is installed over the cylindrical member 54 by aligning the enlarged portions of the punches with the recesses 66 formed in the cylindrical member 54. Shaft 56 may then be secured in the bore of the cylindrical member 54 and secured therein by key 58.

Figure 2:
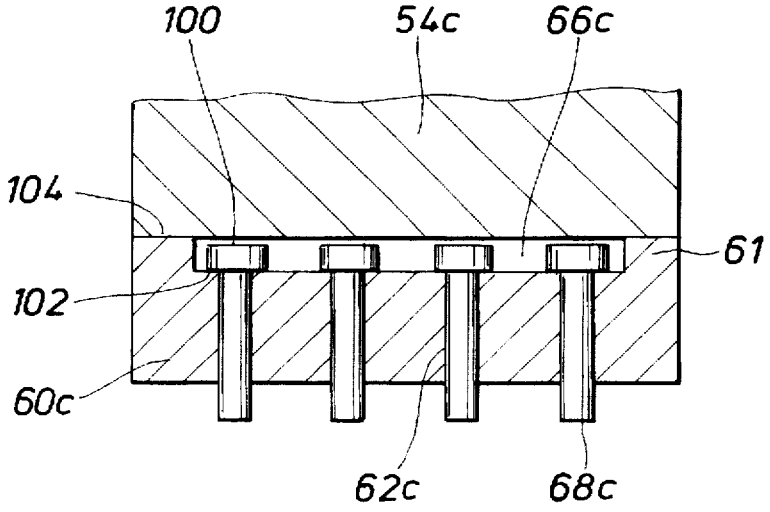
FIG. 2 is a cross-sectional view of an alternative embodiment of the punch roll in which a recess is formed in the internal diameter of the annular ring member.

FIG. 2 is a cross-sectional view of an alternative embodiment of the punch roll cylindrical member 54C and annular ring member 60C each having physical dimensions which cooperative define a recess 66C which receives the enlarged portion of punches 68C. The remaining portion of punches 68C is received in bores 62C. Annular rings 61 are integral to annular ring member 60C and define recess 66C between member 60C and member 54C. The enlarged portion of punch 68C includes a top 100 and an annular shoulder 102. The enlarged portion of punch 68C is trapped between cylindrical member 54C and annular ring member 60C within recess 66C. In this manner, punch member 68C is maintained in radially extending bore 62C by abutment of annular shoulder 102 against annular member 60C in addition to abutment of top 100 against the peripheral surface of cylindrical member 54C.

One skilled in the art will readily recognize that certain specific details shown in the foregoing specification and drawings are exemplary in nature and subject to modification without departing from the teachings of the disclosure. Various modifications of the invention discussed in the foregoing description will become apparent to those skilled in the art. All such variations that basically rely on the teachings through which the invention has advanced the art are properly considered within the spirit and scope of the invention.

We claim:

1. A punch roll comprising:

an axially extending annular member;

said annular member defining an opening extending axially therethrough, said annular member being characterized by opposed end portions each having a first radial dimension and an intermediate portion characterized by a second radial dimension, an axially extending cylindrical member defining a third radial dimension;

said third dimension being smaller than said first dimension and said cylindrical member being telescopically received within said annular member;

a punch member comprising a cylindrical member disposed in close fitting relation within a radially extending bore defined in said annular member;

said punch member including an end portion having a radially enlarged dimension defining a head;

said head having a first portion defining an annular shoulder and an opposing second portion defining a top;

said punch member being maintained in said radially extending bore by abutment of said annular shoulder against said annular member; and said top disposed in abutment against a peripheral surface of said cylindrical member.

* * * * *